United States Patent [19]

Sells

[11] Patent Number: 4,807,409

[45] Date of Patent: Feb. 28, 1989

[54] VENTED FASCIA BOARD

[75] Inventor: Gary L. Sells, Mishawaka, Ind.

[73] Assignee: Cor-A-Vent, Inc., Mishawaka, Ind.

[21] Appl. No.: 63,106

[22] Filed: Jun. 17, 1987

[51] Int. Cl.[4] ..... E04B 7/00

[52] U.S. Cl. ..... 52/95; 52/199; 52/303

[58] Field of Search ..... 52/95, 199, 303, 305, 52/473; 98/42.22, DIG. 6

[56] References Cited

U.S. PATENT DOCUMENTS

| | | | |
|---|---|---|---|
| 2,676,554 | 4/1954 | Wenger | 52/95 |
| 3,204,379 | 9/1965 | Osborn | 52/303 X |
| 3,373,676 | 3/1968 | Dunnington et al. | 98/DIG. 6 X |
| 3,683,785 | 8/1972 | Grange | 52/95 X |
| 3,766,694 | 10/1973 | Minialoff et al. | 52/199 X |
| 4,665,675 | 5/1987 | Kelly | 52/303 X |

*Primary Examiner*—Carl D. Friedman
*Attorney, Agent, or Firm*—James D. Hall

[57] ABSTRACT

A vented fascia board construction positioned between the soffit and the roof of a building to insure a smooth flow of air to the roof area. The fascia board is constructed of vent material which forms a plurality of tubular openings or passages which extend so that one end of the passages open downward and the other end of the passage terminate between the roof and soffit.

10 Claims, 2 Drawing Sheets

Fig. 3
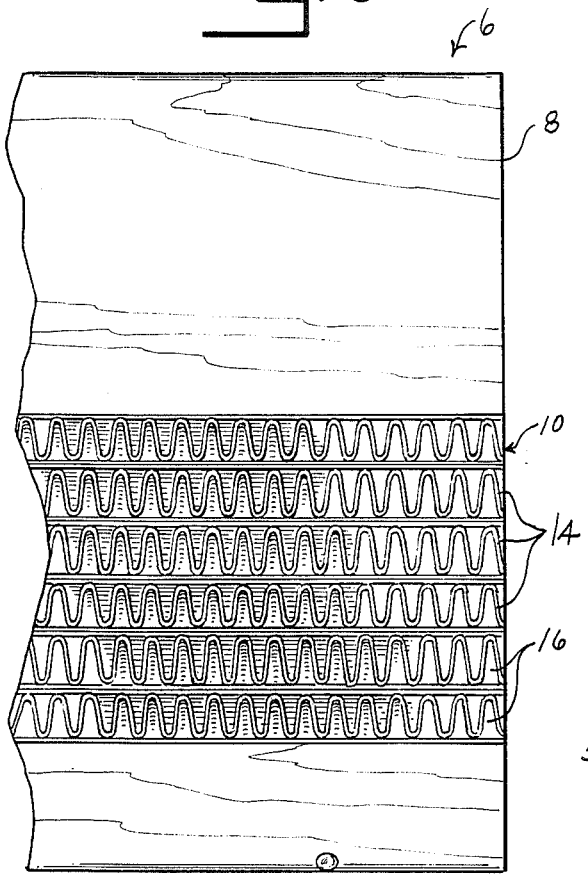
Fig. 4
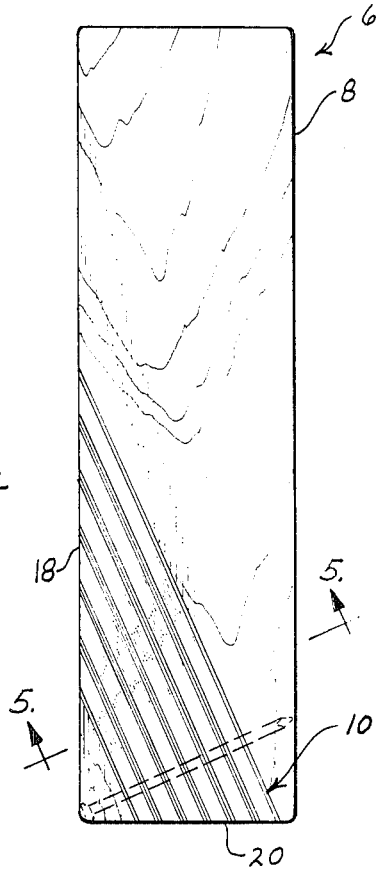
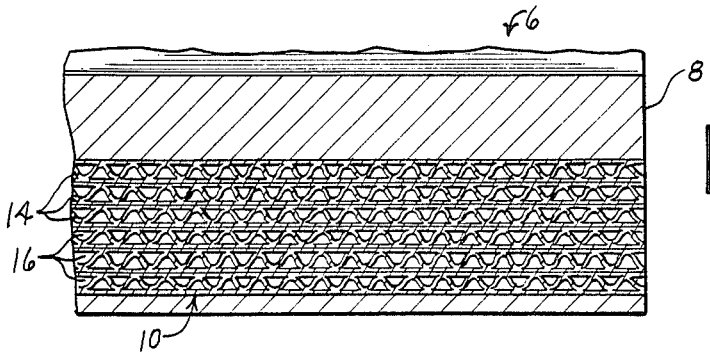
Fig. 5

VENTED FASCIA BOARD

SUMMARY OF THE INVENTION

This invention relates to a fascia board used in building roof construction.

Heretofore, to provide ventilation to a roof, builders have implemented a vent to the fascia board edge and soffit as illustrated in U.S. Pat. Nos. 3,683,785, 3,972,164 and 4,269,007. One problem associated with such devices is the added cost in home construction due to the use of multiple parts involved in the venting.

The fascia board construction of this invention eliminates the problems associated with the prior art by providing a one piece fascia board and vent. The fascia board is partially constructed of corrugated material to form a multiplicity of passages through the board which provides a sturdy one piece fascia board and vent construction.

Accordingly, an object of this invention is to provide for a one piece fascia board and vent construction.

Another object of this invention is to provide for an economical device to vent the roof of a building that prevents moisture from entering.

Further objects will become apparent upon a reading of the description below.

DESCRIPTION OF THE DRAWINGS

FIG. 3 is a fragmentary elevational view of the fascia board of this invention.

FIG. 4 is an end view of the fascia board of this invention.

FIG. 5 is a fragmentary sectional view taken along lines 5—5 of FIG. 4.

DESCRIPTION OF THE PREFERRED EMBODIMENT

Figure 1:
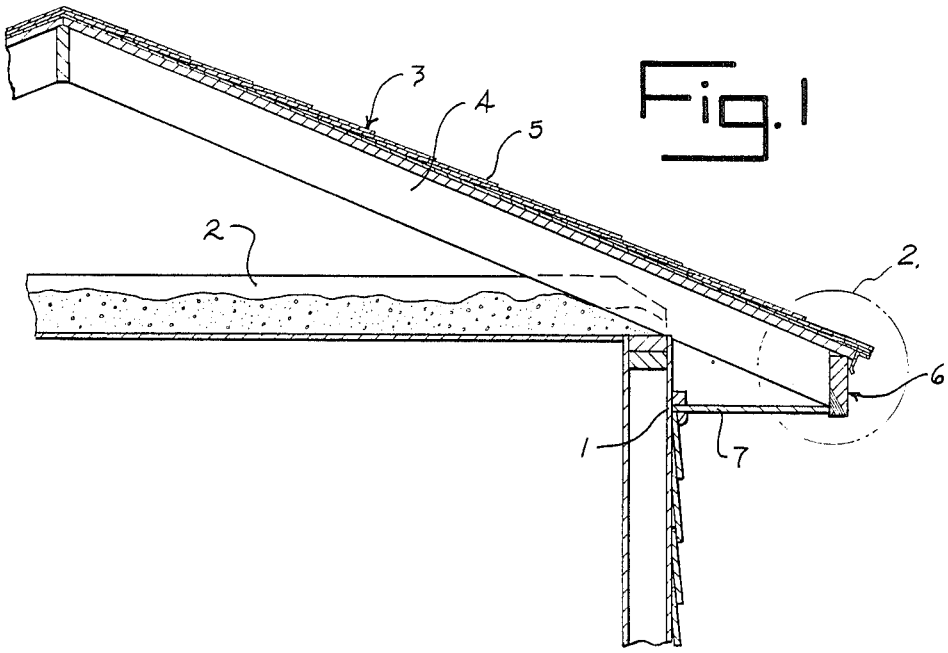
FIG. 1 is a fragmentary cross-sectional view of a roof showing the vented fascia board of this invention positioned between the soffit and roof extension.

The preferred embodiment herein described is not intended to be exhaustive or to limit the invention to the precise form disclosed. It is chosen and described to explain the principles of the invention and its application and practical use whereby others skilled in the art may utilize the invention.

The drawings illustrate a partial view of a typical dwelling having a side wall 1, ceiling joists 2 and a roof 3. The roof includes a plurality of rafters 4 which carry a roof deck 5 covered by conventional asphalt or wood shingles.

A fascia board 6 is secured to the outer ends of rafters 4 and in a like fashion a soffit board 7 is secured to the lower ends of rafters 4 as well as to wall 1. Thus far, the construction disclosed is that of a conventional building roof.

Figure 2:
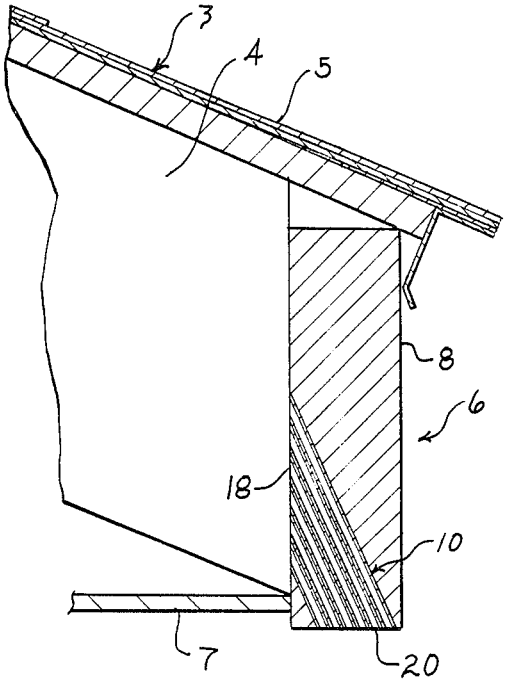
FIG. 2 is a detailed cross-sectional view of the area within broken circle 2 of FIG. 1.

Fascia board 6 of the invention is shown in detailed vertical cross-section in FIG. 2. Fascia board 6 includes an elongated beam 8 preferably formed of wood and a corrugated vent 10 secured either by a nail (FIG. 4) or by glue to the beam at an oblique angle and extending the length thereof. Vent 10 is preferably formed of semi-rigid or rigid plastic material.

As shown in FIG. 5, corrugated vent 10 includes multiple corrugated layers 14 which define a plurality of tubular openings or passages 16. Openings 16 extend from inner face 18 to a lower face 20 of vent 10 and provide air paths from lower edge 20 to inside face 18 of the fascia board 6.

In use, fascia board 6 is normally positioned as is shown in FIGS. 1 and 2 with corner 12 of the board abutting soffit board 7. In its normal position, the inner faces of vent passages 16 are located above soffit 7 and below roof 3. Lower edge 20 is facing downwardly and is open to the ambient surroundings to provide a passage for the air while inhibiting ingress of moisture and insects under the roof area.

It is to be understood that the invention is not limited to the details above given but may be modified within the scope of the appended claims.

I claim:

1. In combination, a building roof including a fascia board having an inner face and lower and upper edges, said roof having rafters supporting a deck and extending past the side wall of the building structure, a soffit board extending horizontally outwardly from said side wall adjacently under said rafters and terminating in an outer edge, said fascia board secured between the outer edge of said soffit board and said roof deck and being generally vertical, the improvement wherein said fascia board includes an elongated beam and an elongated vent part secured to said beam, said vent part including a plurality of passages positioned at an oblique angle relative to said soffit, said passages extending downwardly through said fascia board from said inner face below the upper edge thereof through said lower edge of said board.

2. The combination of claim 1 wherein said beam defines in part the inner face and lower edge of said board.

3. The combination of claim 1 wherein said vent part is a plurality of corrugated layers defining said passages.

4. In combination, a building roof including a fascia board having an inner face and lower edge, said roof having rafters supporting a deck and extending past the side wall of the building structure, a soffit board extending horizontally outwardly from said side wall adjacently under said rafters, said fascia board secured between the outer edge of said soffit board and said roof deck and being generally vertical, the improvement wherein said fascia board includes an elongated beam and an elongated vent part secured to said beam, said vent part including a plurality of passages positioned at an oblique angle relative to said soffit, said passages extending downwardly through said fascia board from said inner face through said lower edge of said board.

5. The combination of claim 4 wherein said beam defines the inner face of said board.

6. The combination of claim 4 wherein said vent part is a plurality of corrugated layers defining said passages.

7. A vented board adapted for use in building construction, said vented board comprising an elongated beam having inner and outer faces between an edge, an elongated vent part secured to said beam, said vent part including a plurality of peripherally enclosed closely adjacent open ended passages positioned at an oblique angle relative to said beam inner face and formed in a thin wall honeycomb configuration extending from said inner face toward said outer face of said beam, said vent part extending continuously along the length of the beam.

8. The vented board of claim 7 wherein said passages extend between said inner face and edge of said beam.

9. The vented board of claim 7 wherein said vent part is of a plurality of corrugated layers defining said passages.

10. In combination, a building roof including a fascia board having an inner face and lower and upper edges, said roof having rafters supporting a deck and extending past the side wall of the building structure, a soffit board extending horizontally outwardly from said side wall adjacently under said rafters and terminating in an outer edge, said fascia board secured between the outer edge of said soffit board and said roof deck and being generally vertical, the improvement wherein said fascia board includes an elongated vent part having a plurality of passages positioned at an oblique angle relative to said soffit, said passages extending downwardly through said fascia board from said inner face below the upper edge thereof through said lower edge of said board, said vent part extending the length of said fascia board.

* * * * *